US006804889B2

(12) United States Patent
Ishikawa et al.

(10) Patent No.: US 6,804,889 B2
(45) Date of Patent: Oct. 19, 2004

(54) SCRIBE DEVICE

(75) Inventors: Hirokazu Ishikawa, Nishitokyo (JP); Toshio Hayashi, Tokyo (JP); Fujio Tateda, Tokyo (JP); Jun Sakamoto, Tokyo (JP); Hideo Oka, Yokohama (JP)

(73) Assignees: Beldex Corporation, Tokyo (JP); THK Co., Ltd., Tokyo (JP)

( * ) Notice: Subject to any disclaimer, the term of this patent is extended or adjusted under 35 U.S.C. 154(b) by 0 days.

(21) Appl. No.: 10/389,799

(22) Filed: Mar. 18, 2003

(65) Prior Publication Data

US 2003/0177650 A1 Sep. 25, 2003

(30) Foreign Application Priority Data

Mar. 19, 2002 (JP) ..... 2002-075949

(51) Int. Cl.[7] ..... B26D 3/08; B43L 13/00

(52) U.S. Cl. ..... 33/18.1; 83/879; 33/32.3

(58) Field of Search ..... 33/18.1, DIG. 2, 33/32.1, 32.3; 83/880–881, 879; 225/94, 96, 96.5

(56) References Cited

U.S. PATENT DOCUMENTS 2,556,757 A * 6/1951 Guild ..... 33/32.5
3,845,561 A * 11/1974 Elsdoerfer ..... 33/556
4,070,936 A * 1/1978 Duncan ..... 83/861
4,175,684 A * 11/1979 Butler ..... 225/2
4,220,066 A * 9/1980 Hargreaves et al. ..... 83/886
4,502,225 A * 3/1985 Lin ..... 33/18.1
6,442,852 B1 * 9/2002 Shimotoyodome ..... 33/32.1
6,460,257 B1 * 10/2002 Shimotoyodome ..... 33/18.1
6,460,258 B1 * 10/2002 Shimotoyodome ..... 33/18.1
6,470,782 B1 10/2002 Shimotoyodome et al.
6,536,121 B1 * 3/2003 Ishikawa et al. ..... 33/18.1

FOREIGN PATENT DOCUMENTS

JP 9-278473 10/1997
JP 2954566 7/1999
JP 2001-48562 2/2001

* cited by examiner

*Primary Examiner*—G. Bradley Bennett
(74) *Attorney, Agent, or Firm*—Westerman, Hattori, Daniels & Adrian, LLP

(57) ABSTRACT

A holder 20 is rotatably connected to a body 10. A scribe tool 30 is attached to one end of the holder 20. A plate spring 16 is fixed to the body 10, and a receiving plate 26 is fixed to the holder 20. A piezo-actuator 40 is interposed between the plate spring 16 and the receiving plate 26. One end of a plate spring 50 having a small spring constant is fixed to the holder 20. The body 10 is provided with an adjustment screw 60. When a lower end part 65 of the adjustment screw 60 is protruded, the lower end part 65 presses the plate spring 50 for flexure, thereby generating a resilient force to the plate spring 50. By this, a rotational force is given to the holder 20 and thus a pressing load directing toward a workpiece is given to the scribe tool 30.

11 Claims, 3 Drawing Sheets

SCRIBE DEVICE

BACKGROUND OF THE INVENTION

This invention relates to a scribe device for forming a scribe line on a flat plate-shaped workpiece.

The most primitive scribe device includes a holder, and a disc-shaped cutter rotatably disposed at a lower end of the holder. The peripheral edge of the cutter is sharpened. In this scribe device, by moving the holder with the cutter pressed against the surface of the workpiece, a scribe line is formed on the surface of the workpiece by the peripheral edge of the cutter.

In the above device, the nearby area of the scribe line on the workpiece is easily fractured because a large pressing load is imposed on the workpiece by the cutter. This makes it difficult to form a clear scribe line on the workpiece. In order to overcome this difficulty, the present applicant has developed a scribe device as disclosed in Japanese Patent Application Laid-Open No. H09-278473. This device includes a body, a plate spring (resilient member) one end of which is connected to the body, a piezo-actuator for feeding a vibration energy to this plate spring, and a scribe tool fixed to the other end of the plate spring. In this device, the scribe tool is pressed against the workpiece by the resiliently deformed plate spring. In that pressing state, when the piezo-actuator is driven while moving the body along the workpiece, the vibration energy of the piezo-actuator is transmitted to the scribe tool through the plate spring. By this, the scribe tool strikes the workpiece while moving along the workpiece surface, thus enabling to generate a continuous vertical a crack on the workpiece and hence enabling to form a scribe line thereon.

In the above device, the plate spring is intended to undertake such roles as to retain at a tip thereof the scribe tool, as to give a pressing load to the scribe tool so as to be imposed on the workpiece, and as to transmit vibrations from the piezo-actuator to the scribe tool.

However, since the plate spring has many roles, the above device is not suited to use for scribing a thin workpiece which is made of fragile material such as a silicone wafer, a semiconductor compound, or the like. That is, since the plate spring undertakes such roles as to retain the scribe tool and as to transmit vibrations, it is necessary to set the spring constant large. For this reason, an overly large pressing load is occasionally imposed on a thin workpiece. Moreover, the scribe tool is poor in followability with respect to fine irregularities formed on the workpiece, and the pressing load varies widely. Furthermore, since the vibrations of the piezo-actuator is transmitted to the scribe tool through the plate spring, it is difficult to transmit the vibrations in a stable manner. As a result, it is very difficult for this device to form a clear scribe line on a thin workpiece.

The present applicant has also developed another scribe device as disclosed in Japanese Patent Application Laid-Open No. 2001-48562. In this scribe device, a large mass including a body, a holder, a piezo-actuator, and the like is guided by a slide mechanism, floated and resiliently supported by a magnet. However, this device has the following problems. Since the workpiece is struck by a large mass, the impact given to the workpiece becomes overly large. Moreover, in order to retain a large mass, the spring constant for the magnet becomes large. Thus, followability with respect to fine irregularities formed on the workpiece is poor and the pressing load varies widely. As a result, even those devices are unable to form a clear scribe line on a thin workpiece.

SUMMARY OF THE INVENTION

In order to solve the above problems, a scribe device according to the present invention comprises (a) a body, (b) a holder rotatably supported by the body, (c) a scribe tool attached to one end part of the holder, (d) a vibration generating member disposed at the holder and for feeding a vibration energy to the scribe tool through the holder, (e) a resilient member one end of which is fixed to the holder, and (f) a pressing member disposed at the body and for pressing the resilient member for flexure, thereby giving a rotational force to the holder and thus giving a pressing load directing toward a workpiece to the scribe tool.

In the above construction, the resilient member undertakes only a role for giving a pressing load to be imposed on the workpiece to the scribe tool. but it does not undertake roles for retaining the scribe tool and for transmitting vibrations. For this reason, the spring constant of the resilient member can be set small and the pressing load can be reduced. Therefore, the scribe tool can follow the fine irregularities formed on the workpiece surface and the variation of the pressing load can be reduced. Furthermore, the vibrations coming from the vibration generating member can be transmitted from the holder to the scribe tool without through the resilient member in a stable manner. In addition, an impact load can be given to the workpiece with a comparatively small mass. As a result, a clear scribe line can be formed on a workpiece even if the workpiece is thin.

According to one embodiment of the above device, the body and the holder are respectively provided with mutually opposing receiving parts and the vibration generating member is disposed between those receiving parts. Owing to this arrangement, the vibration energy coming from the vibration generating member can surely be fed to the scribe tool.

In the above-mentioned one embodiment, the body is provided with an auxiliary resilient member serving as the receiving part of the body. Owing to this arrangement, it can be prevented to impose an overly large pressing load on the workpiece with the scribe tool climbed over the workpiece.

Preferably, the auxiliary resilient member is composed of a plate spring. Owing to this arrangement, the vibration energy can be transmitted to the scribe tool in a stable manner.

According to another embodiment of the above-mentioned device, the holder includes a first holder part rotatably supported by the body, and a second holder part rotatably supported by the first holder part, one end of the resilient member is fixed to the first holder part, the scribe tool is attached to one end of the second holder part, the first holder part and the second holder part are respectively provided with mutually opposing receiving parts, the vibration generating member is disposed between those receiving parts, and the vibration energy coming from the vibration generating member is fed to the scribe tool through the second holder part.

Also in the above-mentioned another embodiment, the same operation and effect as in the first embodiment can be obtained. In addition, the following operation and effect can also be obtained. That is, since the vibration generating member is disposed between the receiving parts of the first and second holder parts, no effect prevailed, under any circumstance, on the relation between the resilient force of the resilient member and the pressing load of the scribe tool to be imposed on the workpiece, and a desired pressing load can surely be obtained.

According to still another embodiment, preferably, the first holder part is provided with a pre-loading member, the pre-loading member is disposed, when viewed from the center of rotation of the second holder part with respect to the first holder part, on the opposite side to the vibration generating member, a pre-load serving as a compressing force is given to the vibration generating member by providing a rotational force to the second holder part. Owing to this arrangement, the vibration generating member can feed a vibration energy to the second holder part and scribe tool in a stable manner.

In the device of the present invention, preferably, the pressing member is composed of an adjustment screw capable of adjusting an amount of projection of a tip part thereof, and the tip part of the adjustment screw is abutted with the resilient member. According to this arrangement, by adjusting the amount of projection of the tip part of the adjustment screw, the resilient force of the resilient member can be adjusted and thus, the pressing load of the scribe tool with respect to the workpiece can be adjusted and therefore, an optimum scribing operation corresponding to the thickness, quality and the like of the workpiece can be performed.

More preferably, the holder is provided with an abutment part, the abutment part is disposed, when viewed from the center of rotation of the holder with respect to the body, on the opposite side to the scribe tool, and the body is provided with a load detecting member for detecting a load from the abutment part. According to this arrangement, by detection of the load which the load detecting member receives from the abutment part, adjustment can be made by correctly anticipating the pressing load of the scribe tool with respect to the workpiece.

Preferably, a product of the mass of one side of a rotation system including the holder with reference to the center of rotation and the distance between its center of gravity and the center of rotation is approximately equal to a product of the mass of the other side and the distance between its center of gravity and the center of rotation. Owing to this arrangement, it is possible to eliminate the effect of the holder, which would otherwise be prevailed on the pressing load of the scribe tool to be imposed on the workpiece.

In all the above-mentioned embodiments, the resilient member is preferably a plate spring. Owing to this arrangement, the pressing load to the scribe tool can be fed in a more stable manner, and the scribe tool can surely be followed to the fine irregularities formed on the workpiece surface.

DETAILED DESCRIPTION OF THE EMBODIMENTS

Figure 1:
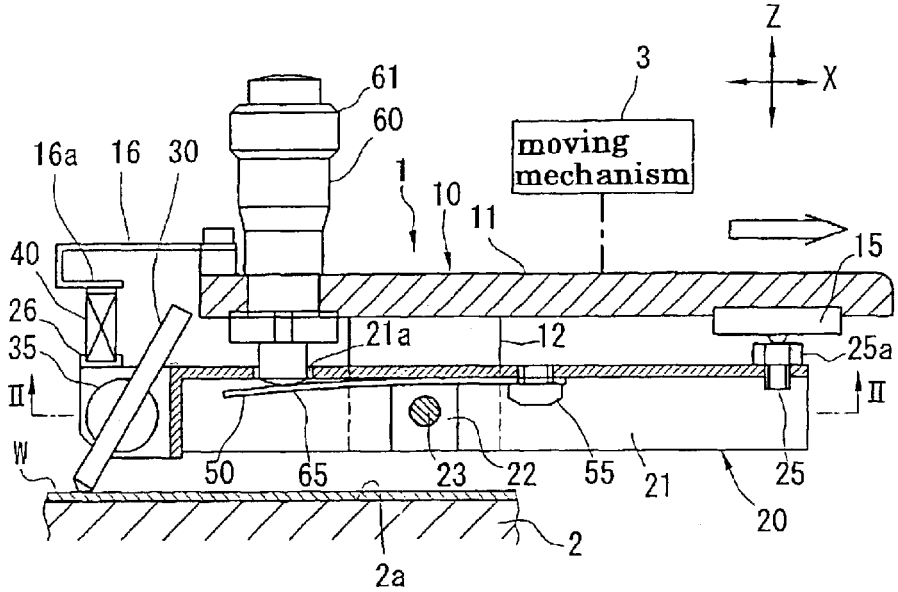
FIG. 1 is a vertical sectional view of a scribe system including a scribe device according to the first embodiment of the present invention.
Figure 2:
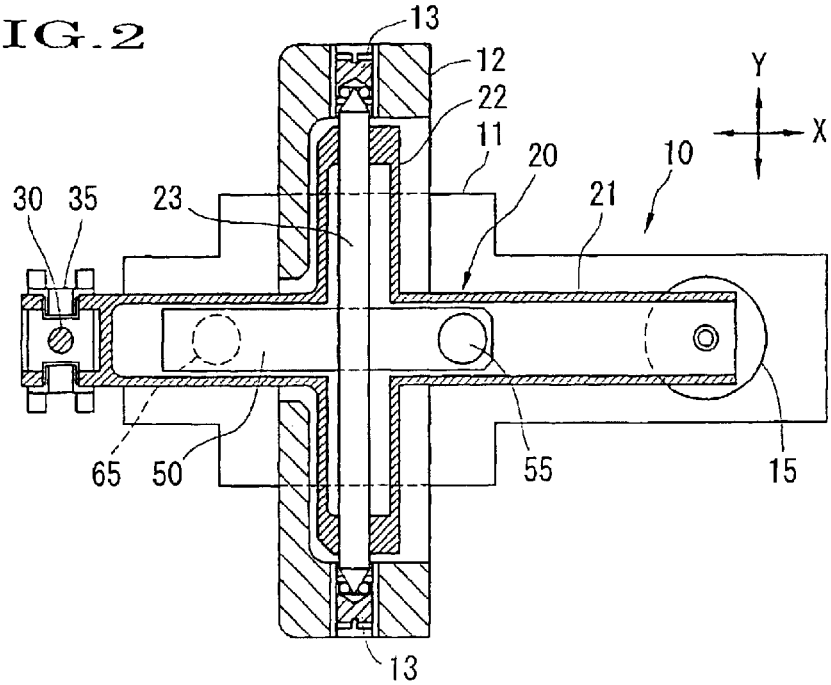
FIG. 2 is a sectional view, when viewed in a direction as indicated by arrows II—II of FIG. 1, of the above scribe device.

A scribe system according to the first embodiment of the present invention will be described hereinafter with reference to FIGS. 1 and 2. The scribe system comprises a scribe device 1, a table 2 having a horizontal flat retaining surface 2*a* on which a workpiece W is to be placed, and a moving mechanism 3 for moving the scribe device 1.

Schematically, the scribe device 1 comprises a body 10, a holder 20 rotatably supported by the body 10, a scribe tool 30 attached to the holder 20, a piezo-actuator 40 (vibration generating member) for feeding a vibration energy to the holder 20, a plate spring 50 (resilient member) attached to the holder 20, an adjustment screw 60 (pressing member) for adjusting the resilient force of the plate spring 50.

The scribe device 1 will be described hereinafter in detail with reference to a horizontal X-axis (axis parallel to the retaining surface 2*a* and extending in a left-and-right direction in FIG. 1), a horizontal Y-axis (axis orthogonal to the X-axis and parallel to the retaining surface 2*a*), and a vertical Z-axis (axis orthogonal to the retaining surface 2*a*). The body 10 includes a horizontal substrate part 11 extending in the X-axis direction and parallel to the retaining surface 2*a*, and a supporting part 12 disposed at a lower surface at an intermediate position of the substrate part 11. As shown in FIG. 2, this supporting part 12 extends in the Y-axis direction and has one pair of bearings 13 on both ends thereof. The substrate part 11 is provided on a lower surface of a right end part thereof with a load cell 15 (load detecting member) and on an upper surface of a left end part thereof with a plate spring 16 (auxiliary resilient member). This plate spring 16 horizontally is extended in the left direction, bent downward at right angles and then bent in the right direction at right angles. A horizontal part 16*a* on the lower side of this plate spring 16 serves as a receiving part for the piezo-actuator 40.

The holder 20 including a first part 21 extending in the X-axis direction and a second part 22 extending in the Y-axis direction, is in the shape of a cross. Those first and second parts 21, 22 are opened at lower parts thereof and each have a hollow interior. Moreover, the first part 21 is provided with a plurality of small holes, not shown, so as to reduce the weight.

A shaft 23 (rotation axis) extending in the Y-axis direction pierces through both ends of the second part 22 of the holder 20 and is fixed by a screw, not shown, or the like. Both ends of the shaft 23 are sharpened, protruded and rotatably supported by the bearings 13. As a result, the holder 20 is rotatably supported by the body 10 for rotation about the shaft 23.

A screw 25 is attached to a right end part of the holder 20, and a head part of this screw 25 serves as an abutment part 25*a* for the load cell 15.

A receiving plate 26 (receiving part of the holder 20) is laid over the upper surface of a left end part of the holder 20. The piezo-actuator 40 is fixed at a lower end part thereof to the receiving plate 26 and at an upper end part thereof to the lower horizontal part 16*a* of the plate spring 16 which is attached to the body 10.

The holder 20 is provided at the left end part with a retaining mechanism 35, by which the scribe tool 30 is retained. The scribe tool 30 is in the shape of a rod and a lower end part thereof is sharpened. A diamond grain is attached to the sharpened tip of the scribe tool 30. The retaining mechanism 35 can adjust the inclination angle of the scribe tool 30 corresponding to the material of the workpiece W.

A right end part of an elongated plate spring 50, which is elongated in the X-axis direction, is fixed, by a screw 55, to the lower surface of the holder 20 at a position which is away rightward from the shaft 23 (rotation axis). On the other hand, the body 10 is provided with an adjustment screw 60 (pressing member). A lower end part 65 (tip part) of the adjustment screw 60 pierces through a hole 21*a* formed in the first part 21 of the holder 20 at a position which is away leftward from the shaft 23 and projects from the lower surface of the holder 20 to abut with the plate spring 50, thereby pressing the plate spring 50 for flexure. As apparent from the description made hereinbefore, the fixing point and pressing point of the holder 50 are located on the opposite sides when viewed from the center of rotation of the holder 20.

By turning a control ring 61 of the adjustment screw 60, an amount of protrusion of the lower end part 65 from the lower surface of the holder 20 can be adjusted. When the amount of protrusion of the lower end part 65 is zero, an amount of flexure of the plate spring 50 is zero and in contact with the lower surface of the first part 21. As the amount of protrusion is increased, the flexure of the plate spring 50 is increased.

The plate spring 16 is sufficiently large in spring constant so that vibrations of the piezo-actuator 40 are transmitted to the holder 20, as later described. The plate spring 50 is smaller in spring constant than the plate spring 16.

In the rotation system including the holder 20, a product $W_1 \times D_1$ of the mass $W_1$ of the left-side part (including accessory members such as the scribe tool 30 and the retaining mechanism 35) from the center of rotation of the holder 20 and the distance $D_1$ between its center of gravity and the center of rotation is approximately equal to a product $W_2 \times D_2$ of the mass $W_2$ of the right-side part (including accessory members such as screws 25, 55) from the center of rotation and the distance $D_2$ between its center of gravity and the center of rotation.

Although the holder 20 is rotatably about the shaft 23, this rotating area is very small. That is, since the left-side part of the holder 20 is connected to the body 10 through the piezo-actuator 40 and the plate spring 16, a large rotation of the holder 20 is prohibited.

Operation of the scribe system thus constructed will be described next. In a state where the scribe device 1 is away from the workpiece W, the left end part of the holder 20 is connected to the left end part of the body 10 through the piezo-actuator 40 and plate spring 16 and therefore, the holder 20 is held in its standstill state. In a state where the flexure of the plate spring 50 is zero, the detecting amount of the load cell 15 is an initial valve (for example, zero).

When the lower end part 65 of the adjustment screw 60 is protruded from the lower surface of the holder 20, the plate spring 50 is flexed and thus, the amount of flexure of the plate spring 50 is increased. By the resilient force of the flexed plate spring 50, a counterclockwise rotational force, in FIG. 1, is given to the holder 20. In that state, the holder 20 is retained by the plate spring 16 and load cell 15. Accordingly, the load cell 15 detects a load corresponding to the resilient force of the flexed plate spring 50. The operator, while watching the detecting load of the load cell 15, adjusts the amount of protrusion of the lower end part 65 of the adjustment screw 60 and adjusts the resilient force of the plate spring 50.

Then, the moving mechanism 3 connected to the body 10 is driven to move the scribe device 1 downward so that the sharpened tip of the scribe tool 30 is brought into a position displaced from the edge of the workpiece W and very slightly lower (for example, several microns) than the upper surface of the workpiece W. In that state, the scribe device 1 is moved in the right direction (inclination direction of the scribe tool 30) so that the sharpened tip of the scribe tool 30 climbs over the upper surface of the workpiece W. In that climbing-over state, the scribe tool 30 presses the workpiece W with a pressing load attributable to the resilient force of the plate spring 50. Since the displacement amount of the scribe tool 30 with respect to the body 10 is very small before and after the scribe tool 30 climbs over the workpiece W, the plate spring 16 is hardly distorted. For this reason, the pressing load of the scribe tool 30 is hardly affected by the change of the resilient force of the plate spring 16. In case the sharpened tip of the scribe device 30 is bitten into the workpiece W, the displacement amount of the scribe tool 30 with respect to the body 10 is further reduced.

In the above-mentioned state, when vibrations are generated by driving the piezo-actuator 40 while moving the scribe device 1 in the right direction (inclination direction of the scribe tool 30) by driving the moving mechanism 3, the vibrations are transmitted to the scribe tool 30 through the holder 20. As a result, the scribe tool 30 strikes the workpiece W at fine intervals to form a continuous vertical crack, i.e., scribe line.

The plate spring 50 does not undertake a role for retaining the scribe tool 30 nor a role for transmitting vibrations of the piezo-actuator 40. Instead, it undertakes only a role for giving a pressing load to the scribe tool 30. For this reason, the spring constant of the plate spring 50 can be reduced, and in case the above-mentioned thin workpiece W made of a silicone wafer, a compound semiconductor, or the like is to be scribed, the pressing load of the scribe tool 30 with respect to the workpiece W can easily be reduced. Moreover, since the spring constant of the plate spring 50 can be set small, the scribe tool 30 can follow the fine irregularities formed on the surface of the workpiece W without jumping up and down and the variation of the pressing load can be restrained. Furthermore, when impact is exerted to the workpiece W, the mass of the body 10 does not act but only the mass of the holder 20 and of the accessories such as the scribe tool 30, etc. attached to the holder 20 act. This alone or together with reduction of the weight of the holder 20 can reduce an impact load to be given to the workpiece W in one time. Furthermore, since the rotation system including the holder 20 is in a laterally well-balanced condition about the center of rotation, the dead weight of the holder 20 prevails no effect on the pressing load to the workpiece W. As a result, a scribing operation can be performed in a stable manner and a clear scribe line can be formed even on a thin workpiece W.

The moving mechanism 3 can rotate the scribe device 1 by 90 degrees so that a similar scribe line can also be formed in the Y-axis direction. At that time, the scribe device 1 is moved in the inclination direction of the scribe tool 30 along the surface of the workpiece W in the same manner as mentioned above.

A scribe system according to the second embodiment of the present invention will be described with reference to FIGS. 3 and 4, next. In the second embodiment, the corresponding components to those of the first embodiment are denoted by same reference numerals in the Figures and detail description thereof is omitted. Also, since the table 2 and the moving mechanism 3 are same in construction as in the first embodiment, they are omitted in the Figures. In FIG. 4, the substrate part 11 of the body 10 is omitted and only the supporting part 12 is shown.

In a scribe device 1' according to the second embodiment, a holder 20' comprising a first holder part 20A and a second holder part 20B which form mutually separate members is used instead of the holder 20 of the first embodiment. As in the case of the holder 20 of the first embodiment, the first holder part 20A is rotatably supported by the body 10 through the shaft 23. A flat plate part of the first holder part 20A has a plate spring 50 attached to the right side of the center of rotation, and a screw 25 serving as an abutment part with respect to a load cell 15 is attached to a right end part. Moreover, the flat plate part of the first holder part 20A has a hole 21*a* formed in the left side of the center of rotation. This hole 21*a* allows a distal end part of an adjustment screw 60 to pierce therethrough.

The second holder part 20B is in the shape of a box an upper part of which is open. The second holder part 20B is rotatably supported by the first holder part 20A. Specifically, the first holder part 20A is provided at two side walls on the left end part of the first holder part 20A with one pair of bearings 24. A shaft 27 (rotation axis) parallel to the above shaft 23 is rotatably supported by those bearings 24. This shaft 27 pierces through the two side walls of the second holder part 20B and is fixed to those side walls.

A scribe tool 30 is attached to a left end part of the second holder part 20B. A piezo-actuator 40 is disposed between the center of rotation (shaft 27) of the second holder part 20B and the scribe tool 30. Specifically, a recess 28 (receiving part of the second holder part) is formed in a bottom wall of the second holder part 20B. A lower end part of the piezo-actuator 40 is fitted to this recess 28. A screw 29 (receiving part of the first holder part ) is vertically screwed into a left end part of the flat plate part of the first holder part 20A. A lower end part of this screw 29 is to be brought into abutment with an upper end part of the piezo-actuator 40.

A pre-load mechanism 70 is, when viewed from the center of rotation (shaft 27) of the second holder part 20B, disposed on the opposite side to the piezo-actuator 27, i.e., between the shafts 23, 27. This pre-load mechanism 70 comprises a pre-load screw 71 (pre-load member) vertically screwed into the flat plate part of the first holder part 20A, and a belleville spring 72 (resilient member) interposed between a lower end part of the pre-load screw 71 and an upper surface of a rear wall of the second holder part 20B.

Figure 3:
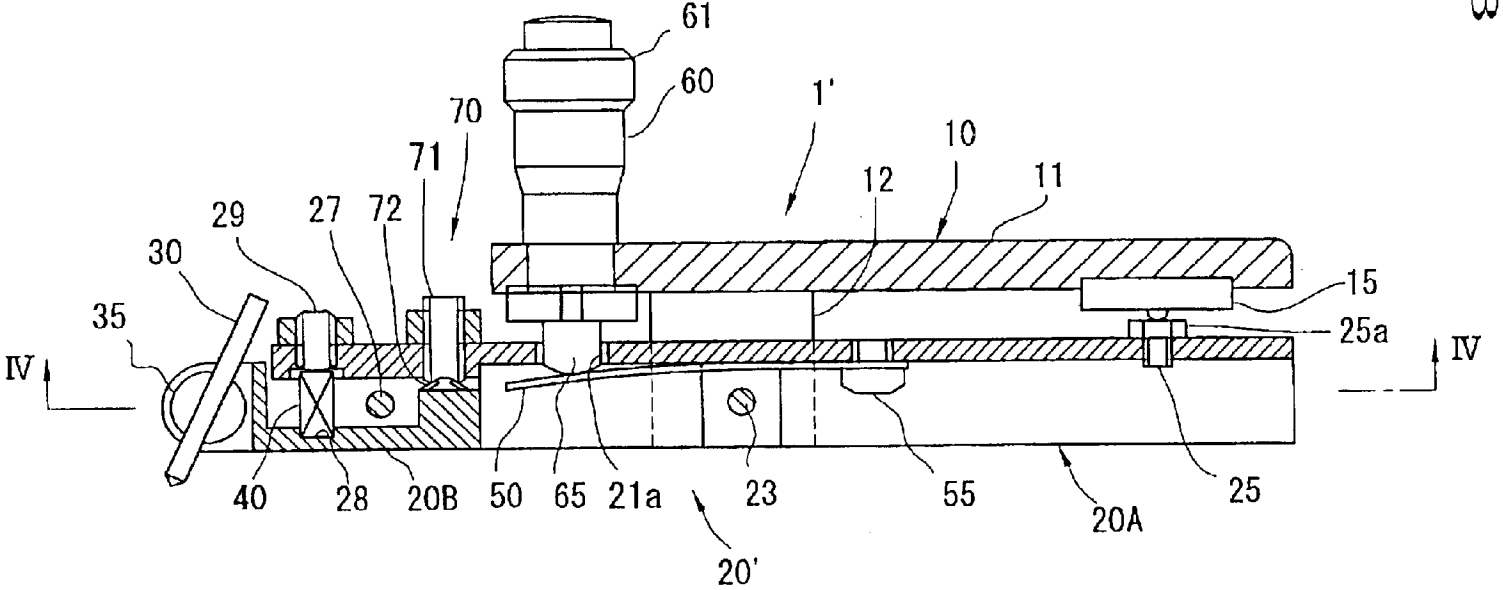
FIG. 3 is a vertical sectional view of a scribe device according to the second embodiment of the present invention.
Figure 4:
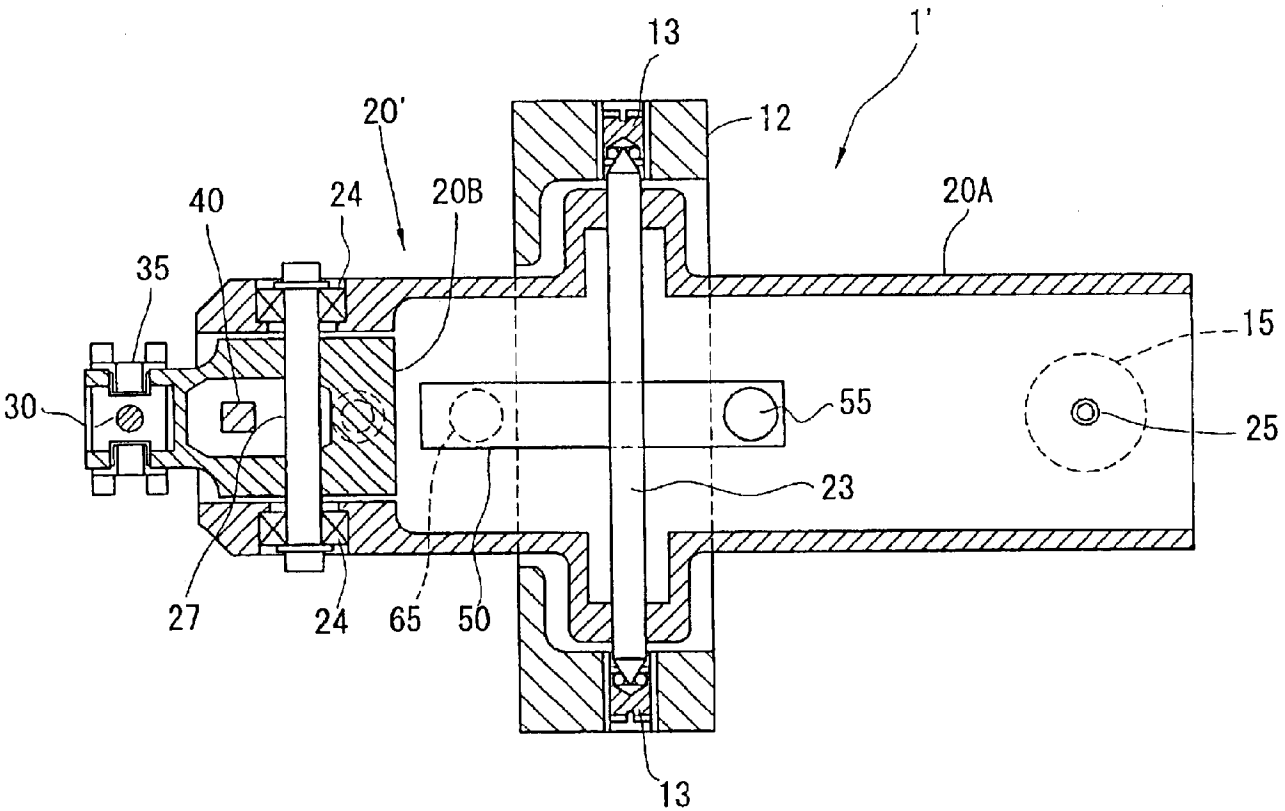
FIG. 4 is a sectional view, when viewed in a direction as indicated by arrows IV—IV of FIG. 3, of the above scribe device.

By screwing the pre-load screw 71 into the second holder part 20B, a clockwise rotational force in FIG. 3 to the second holder part 20B through the belleville spring 72, and the second holder part 20B presses the piezo-actuator 40 against the screw 29 of the first holder part 20A. By doing so, a pre-load is given to the piezo-actuator 40. As a result, the piezo-actuator 40 can output stable vibrations. By adjusting the screwing amount of the pre-load screw 71, the pre-load can be adjusted. Owing to a provision of the belleville spring 72, the pre-load to the piezo-actuator 40 can be finely adjusted, but this belleville spring 72 may be eliminated. Also, instead of the belleville spring 72, a steel ball may be used as a resilient member. Even a steel ball can resiliently deform by several microns.

In the rotation system including the holder 20A, a product of the mass of the left-side part (including accessory members such as the scribe tool 30 and the retaining mechanism 35) from the center of rotation of the holder 20A and the distance between its center of gravity and the center of rotation is approximately equal to a product of the mass of the right-side part (including accessory members such as screws 25, 55) from the center of rotation and the distance between its center of gravity and the center of rotation.

Operation of the scribe device 1' thus constructed will be described. In a state where the scribe device 1' is away from the workpiece W, the rotation system including the first holder part 20A and the second holder part 20B is given a counterclockwise rotational force by the resilient force of the plate spring 50 and this force is received by the load cell 15, and therefore, the rotation system is held in its standstill state.

Then, the moving mechanism is driven to move the scribe device 1' downward so that the sharpened tip of the scribe tool 30 is brought into a position displaced from the edge of the workpiece W and very slightly lower (for example, several microns) than the upper surface of the workpiece W. In that state, the scribe device 1' is moved so that the sharpened tip of the scribe tool 30 climbs over the upper surface of the workpiece W. In that climbing-over state, the scribe tool 30 presses the workpiece W with a pressing load attributable to the resilient force of the plate spring 50. The scribe tool 30 is displaced with respect to the body 10 before and after the scribe tool 30 climbs over the workpiece W and the resilient force of the plate spring 50 is slightly increased in such a manner as to correspond thereto. A pressing load only caused by the resilient force of the plate spring 50 can be given to the scribe tool 30. By taking the increased portion of the resilient force of the plate spring 50 corresponding to the above-mentioned displacement into the load detected at the load cell 15, a correct pressing load can be computed. Since this increased portion is very small, it can be disregarded.

In the above-mentioned state, when vibrations are generated by driving the piezo-actuator 40 while moving the scribe device 1 in the right direction (inclination direction of the scribe tool 30) by driving the moving mechanism 3, the vibrations are transmitted to the scribe tool 30 through the second holder part 20B. As a result, the scribe tool 30 strikes the workpiece W at fine intervals to form a continuous vertical crack, i.e., scribe line. The vibrations are also transmitted in the direction of the first holder part 20A. However, since the mass of the first holder part 20A is larger than the mass of the second holder part 20B, the transmitting amount to the first holder part 20A is small.

Since all the other operation of the scribe device 1' is same as the scribe device 1 of the first embodiment, description thereof is omitted.

The present invention is not limited to the above embodiments, and many other embodiments can be employed. For example, it is accepted that the holder 20 of the first embodiment or the first holder part 20A of the second embodiment is formed with a plurality of screw holes along the longitudinal direction, and the fixing point of the plate spring 50 is changed in accordance with the material and thickness of the workpiece W, thereby changing the spring constant.

The configuration of the body and holder of the first embodiment is not limited to this embodiment. For example, it is accepted that the body and holder are formed in an L-shaped configuration including a horizontal part and an upstanding part, a load cell is disposed at the upstanding part of the body, and an abutment part is disposed at the upstanding part of the holder. This can likewise be applied to the body and first holder part of the second embodiment.

In the first embodiment, the plate spring 16 and the piezo-actuator may be brought closer to the center of rotation of the holder. In that case, the plate spring 16 can be eliminated, if necessary.

The moving mechanism may be designed such that the table is moved with respect to the body.

The scribe device of the present invention may also be used for a comparatively thick workpiece.

According to the present invention described hereinbefore, a clear scribe line can be formed even on a thin workpiece.

What is claimed is:

1. A scribe device comprising:

(a) a body;

(b) a holder rotatably supported by said body;

(c) a scribe tool attached to one end part of said holder;

(d) a vibration generating member disposed at said holder and for feeding a vibration energy to said scribe tool through said holder;

(e) a resilient member one end of which is fixed to said holder; and (f) a pressing member disposed at said body and for pressing said resilient member for flexure, thereby giving a rotational force to said holder and thus giving a pressing load directing toward a workpiece to said scribe tool.

2. A scribe device according to claim 1, wherein said body and said holder are respectively provided with mutually opposing receiving parts and said vibration generating member is disposed between those receiving parts.

3. A scribe device according to claim 2, wherein said body is provided with an auxiliary resilient member serving as said receiving part of said body.

4. A scribe device according to claim 3, wherein said auxiliary resilient member is a plate spring.

5. A scribe device according to claim 1, wherein said holder includes a first holder part rotatably supported by said body, and a second holder part rotatably supported by said first holder part, one end of said resilient member is fixed to said first holder part, said scribe tool is attached to one end of said second holder part, said first holder part and said second holder part are respectively provided with mutually opposing receiving parts, said vibration generating member is disposed between those receiving parts, and the vibration energy coming from said vibration generating member is fed to said scribe tool through said second holder part.

6. A scribe device according to claim 5, wherein said first holder part is provided with a pre-loading member, said pre-loading member is disposed, when viewed from the center of rotation of said second holder part with respect to said first holder part, on the opposite side to said vibration generating member, a pre-load serving as a compressing force is given to said vibration generating member by providing a rotational force to said second holder part.

7. A scribe device according to claim 1, wherein said pressing member is composed of an adjustment screw capable of adjusting an amount of projection of a tip part thereof, and the tip part of said adjustment screw is abutted with said resilient member.

8. A scribe device according to claim 7, wherein said holder is provided with an abutment part, said abutment part is disposed, when viewed from the center of rotation of said holder with respect to said body, on the opposite side to said scribe tool, and said body is provided with a load detecting member for detecting a load from said abutment part.

9. A scribe device according to claim 1, wherein the center of rotation of said holder is at a midpoint in said holder, and wherein a product of the mass of one side of a rotation system including said holder with reference to the center of rotation of said holder and the distance between its center of gravity and the center of rotation is approximately equal to a product of the mass of the other side and the distance between its center of gravity and the center of rotation.

10. A scribe device according to claim 1, wherein said resilient member is a plate spring.

11. A scribe device according to claim 1, wherein the holder is rotatably supported by the body for rotation about the shaft.

* * * * *